United States Patent [19]

Zolik

[11] Patent Number: 4,503,902

[45] Date of Patent: Mar. 12, 1985

[54] HEAT EXCHANGER FOR RECOVERING WASTE HEAT

[76] Inventor: Thomas C. Zolik, 4855 N. Rutherford, Chicago, Ill. 60656

[21] Appl. No.: 325,562

[22] Filed: Nov. 27, 1981

Related U.S. Application Data

[63] Continuation-in-part of Ser. No. 277,248, Jun. 25, 1981, abandoned.

[51] Int. Cl.[3] ..... F24H 3/00; F28D 7/02; B60H 27/00; F24B 7/00

[52] U.S. Cl. ..... 165/47; 165/164; 165/39; 165/40; 165/DIG. 2; 237/55; 236/1 D

[58] Field of Search ..... 165/DIG. 2, 184, 139, 165/102, 99, 103, 164, 11 R, 116, 47, 39, 40; 237/50–55; 236/10, 11; 431/22, 16; 126/131, 99 C, 99 D, 101; 98/46

[56] References Cited

U.S. PATENT DOCUMENTS

| | | | |
|---|---|---|---|
| 1,782,325 | 4/1929 | Thomas | 165/103 |
| 1,941,496 | 5/1933 | Schleh | 165/DIG. 2 |
| 2,343,542 | 3/1944 | Faunce | 165/139 |
| 2,380,026 | 5/1945 | Clarke | 165/96 |
| 2,663,549 | 12/1953 | Otten | 165/166 |
| 2,862,666 | 12/1958 | Kriechbaum | 236/11 |
| 3,006,334 | 10/1961 | Newell | 236/11 |
| 4,044,950 | 8/1977 | Engeling et al. | 165/DIG. 2 |
| 4,163,441 | 8/1979 | Chen | 237/55 |

FOREIGN PATENT DOCUMENTS

| | | | |
|---|---|---|---|
| 576958 | 3/1946 | United Kingdom | 98/46 |

*Primary Examiner*—William R. Cline
*Assistant Examiner*—John K. Ford
*Attorney, Agent, or Firm*—Paul H. Gallagher

[57] ABSTRACT

Heat exchanger means for extracting heat from the flue gases of a warm air furnace is in the form of a tube wound spirally to define a first passageway wherein ambient air is heated by the flue gases passing through a second passageway between segments of the first passageway for the ambient air, the tube being provided with a deflector directing the flue gases through the second passageway and a shroud for controlling exhaust gases passing through and leaving the convolute tube.

2 Claims, 4 Drawing Figures

HEAT EXCHANGER FOR RECOVERING WASTE HEAT

This application is a continuation-in-part of my prior application, Ser. No. 277,248, filed June 25, 1981, now abandoned.

SUMMARY OF THE INVENTION

The invention structure finds application in the capture of heat from exhaust gases of a furnace by the use of a spirally arranged tube, the tube having spaced proximate external surfaces to provide a passageway for heat exchange with the tube, the interior of the tube being connected to means providing movement of ambient air therein.

The tube may be formed in any of various known ways, such as forming it with end walls each formed as a spiral, with major walls connected to the end walls to define a passageway within the tube for movement of ambient air, and passageways between the exterior surfaces of proximate major walls to define a passageway in heat exchange relationship with the air moving within the tube.

The tube is enclosed within a housing disposed between the furnace and the exhaust stack, and the tube is provided with deflectors at the end thereof exposed to the gases incoming to the housing, so as to insure that the tube is exposed to substantially all of the incoming gases. Heat sensor means is provided for controlling the furnace in response to the gases exceeding a predetermined temperature.

DESCRIPTION OF THE PREFERRED EMBODIMENTS

Figure 1:
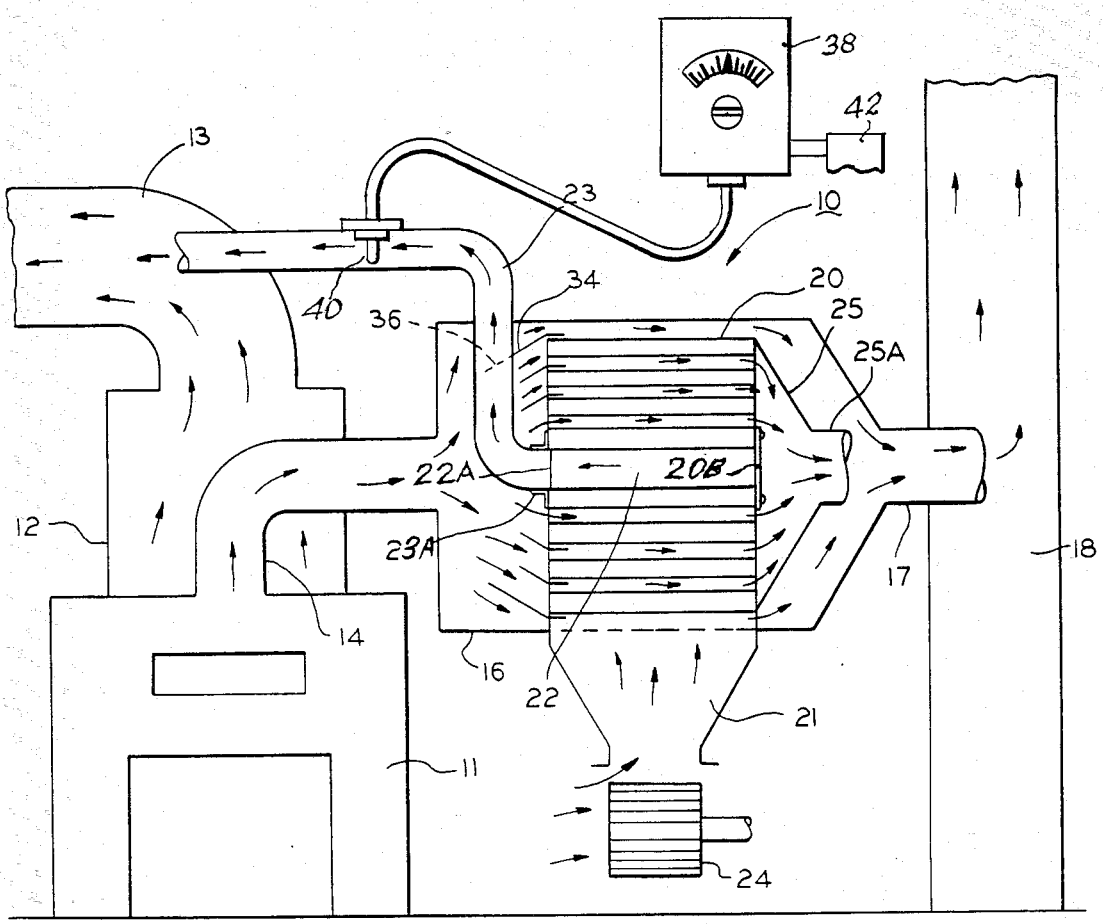
FIG. 1 is a schematic view showing an environment for use of the heat exchanger according to the present invention.

The heat exchanger according to the present invention includes a unit 10 shown in an environment which includes a heating device such as a warm air furnace 11 delivering heated air to a plenum 12 in turn connected to a heat supply duct 13. Exhaust gases leave furnace 11 via an exhaust stack 14 connected to a flue 18. A housing 16 is interposed between stack 14 and flue 18, housing 16 having a reduced exit pipe or terminal portion 17 therefrom to the flue 18.

Housing 16 encloses a heat exchanger component 20 having an entrance 21 thereto extending through a wall of housing 16 and a central space 22 disposed on the axis of the unit and having an outlet end 22A connected to a duct 23 extending through a wall of housing 16 and into heat supply duct 13. The space 22 is formed by and within the inner turn of the component 20 (FIG. 2) and serves as a channel or duct. The duct 23 leads from the space 22, being connected to the unit by a flange 23A fitted to the end of the unit and suitably secured thereto. An end cap 20B is secured to the opposite end of the unit, covering the space 22.

The entrance 21 to heat exchanger component 20 is connected to an air moving device such as a blower 24 preferably driven by a variable speed motor controlled by a rheostat, for moving air at ambient temperature through the heat exchanger 20 for heating of the moving air therein by the exhaust gases from furnace 11, the heated air exiting from heat exchanger 20 via the central space 22 and duct 23 to be delivered to heat supply duct 13.

Suitable control means, not shown, are provided for the blower 24, so that it operates only when furnace 11 operates.

Figure 2:
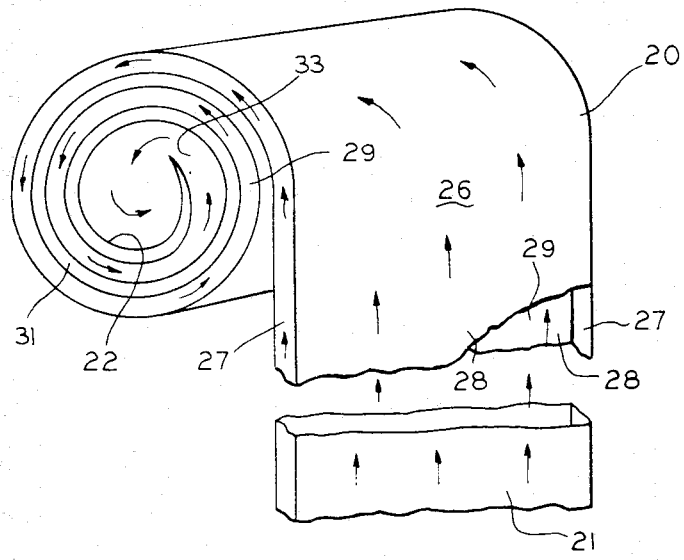
FIG. 2 is a schematic isometric view showing details of the heat exchanger.

The details of heat exchanger unit 20 are best seen with respect to FIG. 2 wherein exchanger 20 is generally in the form of a tube 26 with spaced end walls 27 and spaced major walls 28, walls 27 and 28 defining a passageway 29 within tube 26. The adjacent walls 28 form spaces between their external surfaces for the passage of exhaust gases.

The unit 20, may be formed, for example, by shaping sheet metal, to form both the walls 28, and the end walls 27 as caps, as well as by die casting. It may also be made of any dimensions, within practical limits, both as to number of turns and length in axial direction. As will be understood, the greater these values are, the greater will be the heat transfer. Sheet metal stamping operations may be utilized, for example, the walls 27 being formed as inserts or caps welded to the walls 28. Additionally, it may be made of sections, extending axially to enable a person to select a certain number of them to form the unit of predetermined axial length.

According to the invention herein, exchanger 20 is formed separately from the housing 16. Structure is provided to insure that the walls 27 and 28 forming the passageway 29 are exposed to substantially all of the gases incoming to housing 16.

As seen in several views, exchanger 20 when viewed from the end thereof, is in the form of a spiral, as mentioned. A deflector 34 is secured in any convenient fashion to an end wall 27 exposed closer to the incoming gases as seen in FIG. 1.

Where deflector 34 intersects duct 23 it is relieved at a cut out 36.

Figure 3:
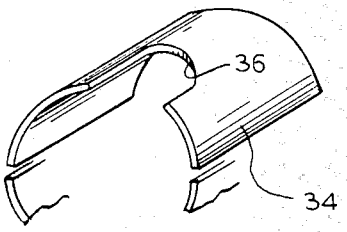
FIG. 3 is a perspective view showing one form of deflector secured to the heat exchanger to direct flue gases thereinto.
Figure 4:
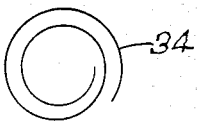
FIG. 4 is a semi-diagrammatic view of another form of deflector.

Deflector 34 may be in the form of a spiral (FIG. 4) of a length equal to the length of the wall 27, which is also of a spiral configuration. Alternatively, deflector 34 may be formed of segments (FIG. 3) conveniently secured to wall 27.

The exhaust gases which have passed through heat exchanger 20 exit therefrom and are directed by a shroud 25 secured to the exit side, or downstream side, of heat exchanger 20 in any convenient manner. Shroud 25 has a reduced terminal portion or exit pipe 25A which directs the exhaust gases to exit pipe 17 of the housing 16.

The provision of the deflectors 34 and the shroud 25 insures that the exhaust gases are passed in a uniform fashion through exchanger 20.

Heat sensor means 38 provides a safety factor, including a sensing element 40 in the duct 23, and a suitable control 42 of known kind. In the event of failure of the blower 24, or a leak that would permit flue gases to enter the unit 20, the temperature in the latter will exceed the desired maximum. The duct 23 extends upwardly through the top of the housing of the heat exchanger, and the excess heat developing upon a failure will occur adjacent the top, and the sensing element is located adjacent this location to quickly sense the high temperature. The control 40, in response to such excess temperature, is operable for shutting off the fuel supply to the furnace, and preferably includes visual light signal means and audio buzzer signal means, to indicate the condition. It is desired that the temperature of the ambient air through the component 20 21 be not lower than that in the plenum 12, for efficiency reasons, and in practice it is maintained at least slightly above it, or about 10° F. above it. As an example of temperatures involved, the normal temperature in the tube 23 is about 175° F., and that in the plenum about 165° F. The temperature of the exhaust gases in the exit pipe 17 is about 265° F. The sensor means may be set to shut off the furnace when the temperature in the tube 23 reaches for example 185°-200° F., although these temperatures are of course representative. Other sensing and control instruments may of course be utilized in connection with other conditions of operation.

For the purpose of maintaining the temperature of the ambient air at the desired value, the blower 24 may be varied in speed, a slower speed and corresponding slower movement of air, results in higher temperature, while conversely, faster movement of air results in lower temperature.

I claim:

1. In combination with a heating device having a heat supply duct for carrying heated air to a space to be heated, and an exhaust stack for carrying exhaust gases to a flue, said combination comprising, a self contained heat exchanger unit separate and apart from the heating device, said heat exchanger unit including an outer housing operably interconnected between the exhaust stack and flue for conducting the exhaust gases therebetween, a heat exchanger component having a main body within said housing and having inlet and outlet elements extending to the exterior, the inlet element having an opening at the exterior at the bottom and the unit including means for impelling air from the exterior, ambient to the unit, through the inlet opening and into and upwardly through the heat exchanger component, the heat exchanger component including a spiral member turned about a longitudinal axis extending between the exhaust stack and flue and having a substantial dimension along that axis and in radial direction, the spiral member including opposed walls defining a spiral passage therebetween having an outer end communicating with the inlet element and an inner end forming a central space at the axis of small radial dimension communicating with the outlet element, said outlet element leading upwardly from the unit and having an elevated portion communicating with the heat supply duct, and control means for controlling said heating device which itself includes heat sensing means in said elevated portion of said outlet element and operable for so controlling said heating device according to the temperature of the air in said elevated portion, said walls also defining spaces between the adjacent turns of the spiral passage extending axially through the component for carrying exhaust gases therethrough and thereby through the component, and the housing and component being so selectively dimensioned as to provide an additional space therebetween nearly around the component and opening at both ends axially.

2. The combination according to claim 1 wherein, the heat exchanger unit includes substantial space through and around the spiral member for relatively free flow of gases therethrough, the heat exchanger component is positioned from the exhaust stack end of the outer housing to form a space at that location, and the spiral member is provided with spiral deflector means at the corresponding end thereof in said space and extending axially toward but terminating short of said end of the outer housing, and spaced axially adjacent respective ones of said spaces between adjacent turns of the spiral passage.

* * * * *